US005448786A

United States Patent [19]

Anderson

[11] Patent Number: 5,448,786

[45] Date of Patent: Sep. 12, 1995

[54] MULTI-PANELED SHOWER CURTAIN

[76] Inventor: James P. Anderson, 157 N. Woodlawn Ave., Avon Park, Fla. 33825

[21] Appl. No.: 389,567

[22] Filed: Feb. 16, 1995

Related U.S. Application Data

[63] Continuation of Ser. No. 225,773, Apr. 11, 1984, abandoned.

[51] Int. Cl.[6] ..... A47K 3/08

[52] U.S. Cl. ..... 4/557; 4/607; 160/236

[58] Field of Search ..... 4/557, 558, 607, 608; 160/168.1 V, 176.1 V, 178.1 V, 236, 900, DIG. 6

[56] References Cited

U.S. PATENT DOCUMENTS

| | | | |
|---|---|---|---|
| 1,112,071 | 9/1914 | Knopf | 160/236 X |
| 2,885,000 | 5/1959 | Merrill | 4/607 X |
| 3,141,954 | 7/1964 | Simon | 160/900 X |
| 3,484,990 | 12/1969 | Kahn et al. | 160/236 X |
| 3,540,154 | 11/1970 | Claudio | 160/236 X |
| 4,202,059 | 5/1980 | Faragher | 4/608 |
| 4,628,981 | 12/1986 | Ciriaci et al. | 160/168.1 V X |

FOREIGN PATENT DOCUMENTS

| | | | |
|---|---|---|---|
| 2701880 | 8/1977 | Germany | 160/168.1 |
| 2163472 | 2/1986 | United Kingdom | 160/236 |

*Primary Examiner*—Charles E. Phillips

[57] ABSTRACT

A barrier to restrict the distribution of water during a showering procedure comprising moveable ogee, S-shaped, panels along a tract housing to be mounted above the opening to the showering area. A mechanism within the tract housing allows for distributing the panels across the opening, followed by rotation of the panels along their vertical axis line perpendicular to the horizontal, to form the barrier. During the retracted open position, the panels are not in contact one with the next. Similarly in the extended open position prior to rotation, the panels are not in contract one with the next. Adequate ventilation is provided to significantly reduce the growth of molds or funguses associated with showering areas.

10 Claims, 6 Drawing Sheets

MULTI-PANELED SHOWER CURTAIN

This is a continuation of application Ser. No. 08/225,773, filed Apr. 11, 1994 now abandoned.

BACKGROUND

Shower curtains and partitioning doors are the most commonly used methods for preventing the escape of the spray of water from the showering area during use. Each has a closed position, which covers the opening or entryway, and an opened position, which leaves the entryway unobstructed.

Shower curtains are attached to a rod located along the upper region of the entryway and the curtain is extended across the opening during use. Following the showering procedure, the shower curtain is either extended across the opening or left retracted to one end of the rod.

Partitioning doors are either used singularly, and generally hinged on one side, or in sets of two doors, which are generally mounted to slide in opposing upper and lower tracks. In the sliding configuration, the doors are generally in a track housing having opposing side members, which with the upper and lower tracks, form a four sided frame. This track housing is less attractive than desired and has the tendency to be difficult to clean. Additionally, the lower track must be crossed to enter and exit the showering area presenting a danger to the user.

Following the showering procedure, when either the curtains or the doors are left in the closed position, the flow of air is restricted to the then wet showering area. This promotes a damp condition within the showering area which promotes the growth of molds and funguses. When left in the open position, partially enclosed areas result which retain the moisture gathered in these sections. This similarly promoting the growth of molds and funguses upon the shower curtain or partitioning door.

For the foregoing reasons, there is a need for a shower curtain which is attractive, functional, safe and provides for adequate ventilation following the showering procedure to reduce the growth of molds and funguses.

SUMMARY

The present invention is directed to a multi-paneled shower curtain that satisfies the needs of providing a satisfactory barrier to prevent the escape of water during the showering procedure. Additionally it provides for adequate ventilation of the showering area following the completion of the showering procedure. Further it eliminates areas which would trap moisture and promote the growth of molds or funguses. All of these advantages are achieved while avoiding the requirement of introducing a bottom tract member.

A shower curtain having features of the present invention comprises an elongated tract member which extends across the upper region of the opening of the showering area. The tract member contains a plurality of panel connectors which are extendable across the entire length of the tract and retractable to one or both ends of the tract. Additionally, the panel connectors are rotatable along their vertical axis. A panel formed of a water resistant material is attached to each of the panel connectors. Each panel extends downward to a position below and to the inside of the upper edge of the lip which is commonly present with showers or below and to the inside of the top of the front of the tub. Prior to the introduction of water, the panels are extended across the opening and rotated to bring the opposing ends of the adjacent panels in contact, in an overlapping manner, to close the opening and form the barrier. Following the showering procedure, the panels are rotated to their open position and then retracted to place the panels at either one end or separated from a mid point to the opposing ends of the tract. When open, the panels are not in contact with each other, but rather are in a spaced relation one to the next, which permits ventilation of the wet side of the panels. The panels can either be left in the retracted position or in the extended position, without rotating the panels to their closed position, to allow drying of the showering area and the multi-paneled shower curtain. The optional addition of a printed pattern on the exterior side of the panels allow for the rotation of the panels while extended across the passageway, following adequate drying time, to form an attractive cover for the showering area.

BRIEF DESCRIPTION OF THE DRAWINGS

These and other features, aspects, and advantages of the present invention will become apparent to those skilled in the art from the following description, appended claims, and accompanying drawings where:

DESCRIPTION

OVERVIEW

Figure 1:
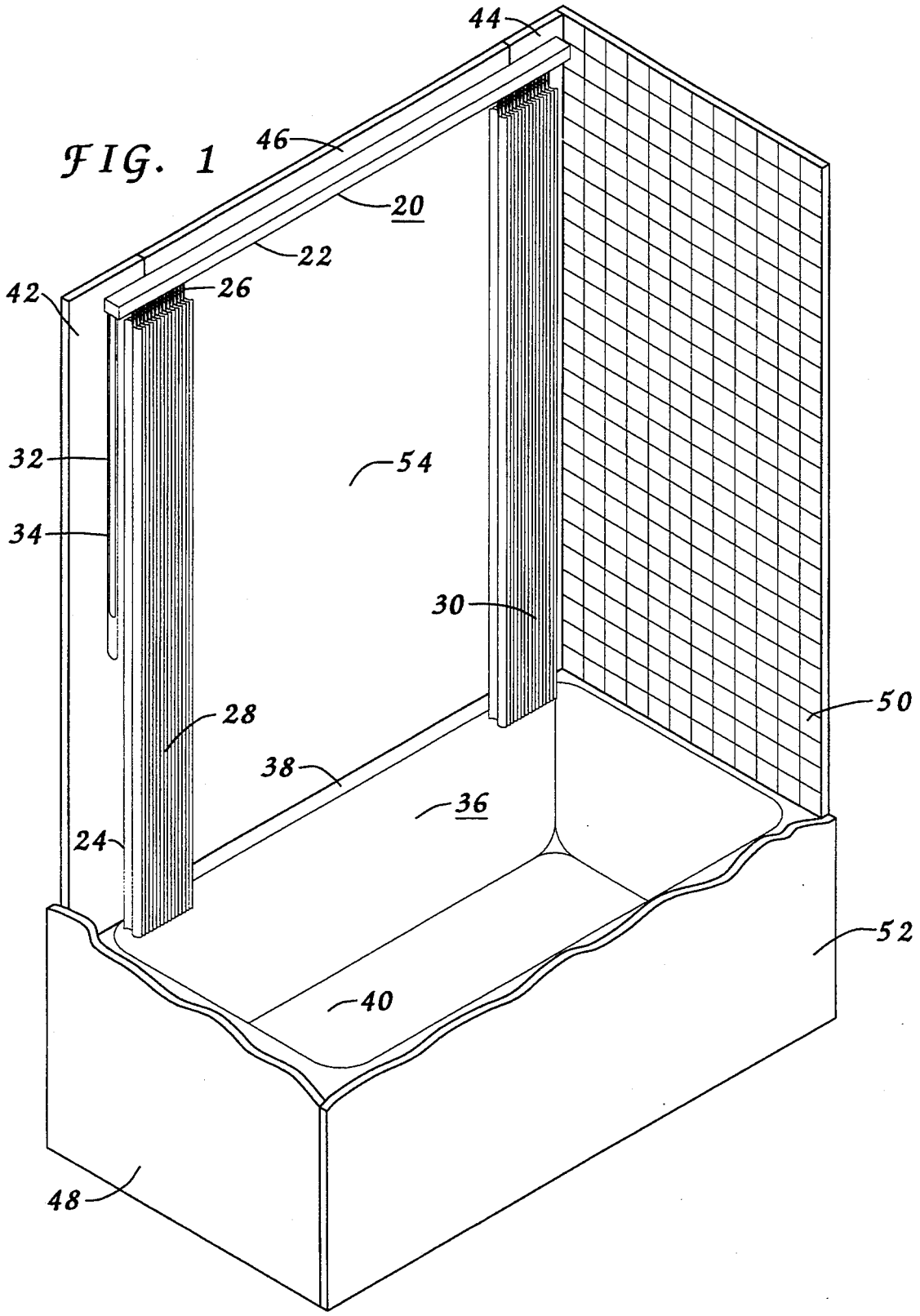
FIG. 1 is a rear perspective view of a bathtub with an embodiment of the multi-paneled shower curtain in the retracted position.
Figure 2:
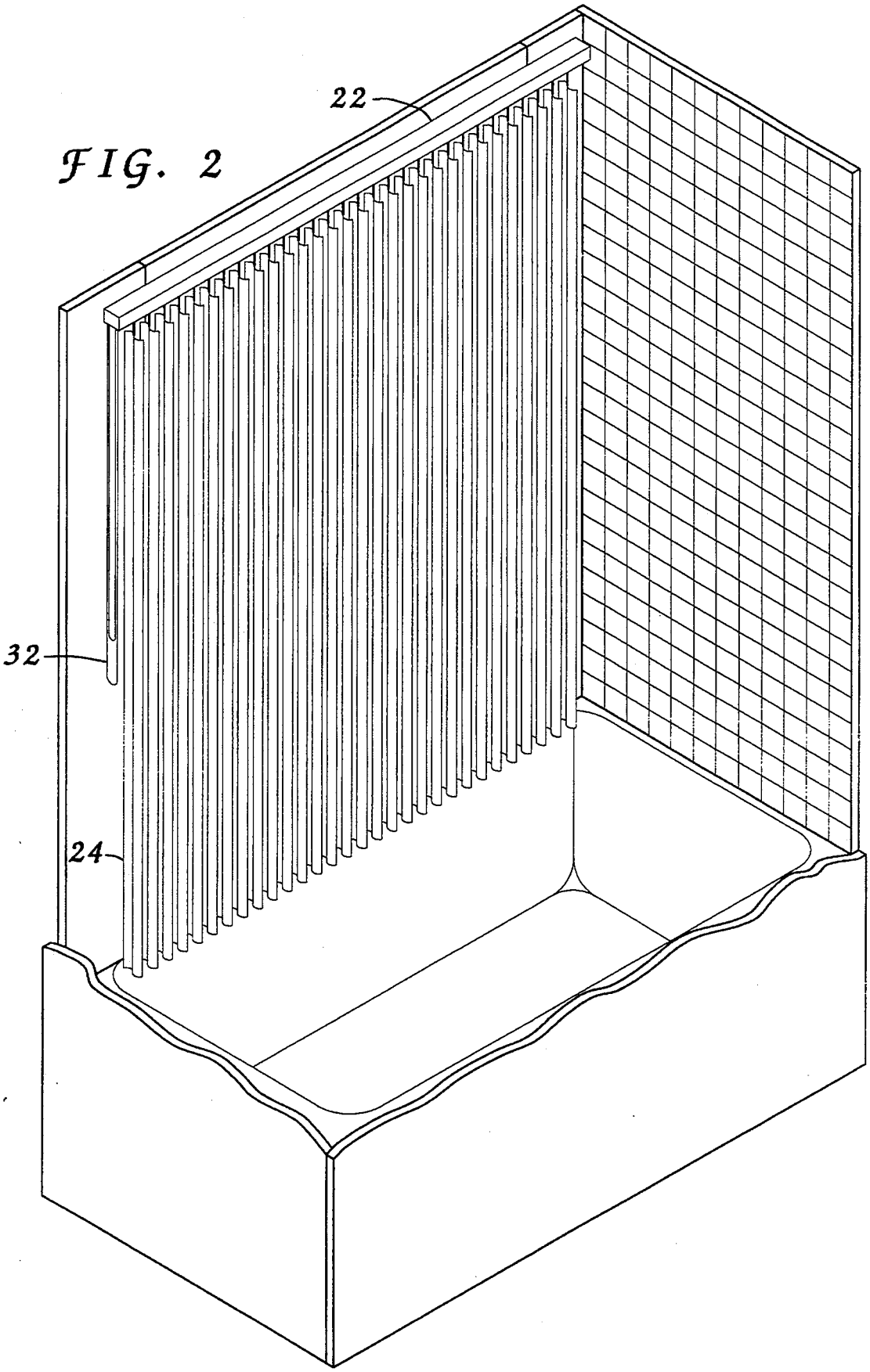
FIG. 2 is a rear perspective view of the multi-paneled shower curtain of FIG. 1 shown extended across the opening.
Figure 3:
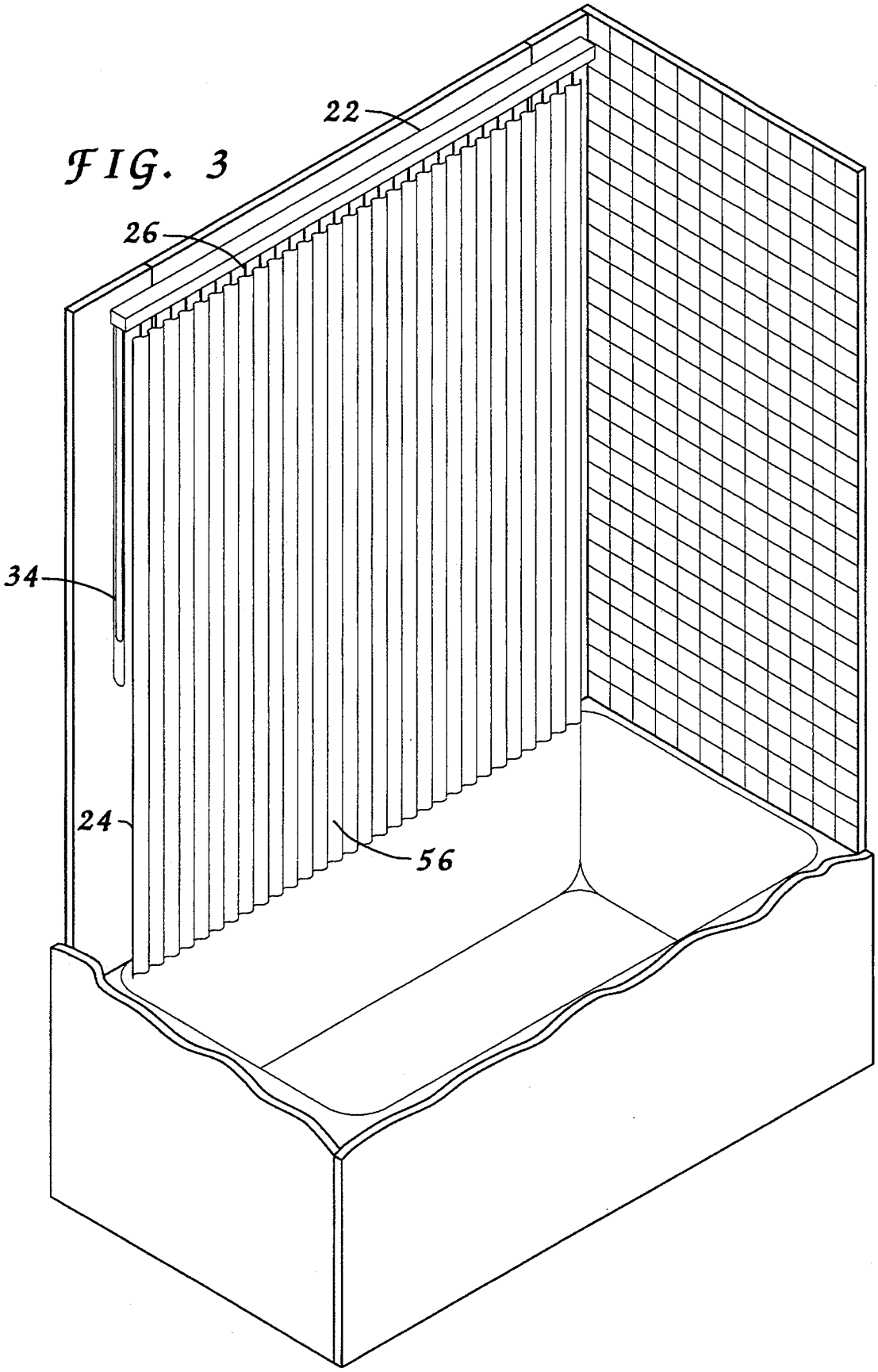
FIG. 3 is a rear perspective view of the multi-paneled shower curtain of FIG. 1 and FIG. 2 shown with the panels rotated to their closed position to form the water barrier.

Referring now to the drawings where like reference numerals refer to like parts throughout the various views. FIGS. 1, 2 and 3 are rear perspective view of a showering area showing the steps involved in deploying the invention. FIG. 1 shows a tub 36 having a tub base 40 and a front upper surface 38. Shown surrounding tub 36 is a first side member 48, a second side member 50, a back wall 52, first front wall 42, second front wall 44 and a center front wall 46. First side member 48 and back wall 52 are shown partially cutaway. It being understood the first side member 48 and back wall 52 would extend to a height relative to the height of second side member 50 to form the showering area. It being further understood that many showering areas do not include the opposing front walls or the center front wall and their presence is not required for the practice of the invention. In existing locations where only the tub and opposing side walls are present, the front walls can be optionally installed to prevent leakage of water around the ends of the multi-paneled shower curtain. Attachment can be accommodated in any of the conventional methods for installing a current use shower curtain rod, such as to the opposing side walls or to the ceiling. An opening 54 is present between first side member 48 and second side member 50 to allow entry and exit to the showering area by a bather. A multi-paneled shower curtain 20 having a tract member 22 is shown attached corresponding to opening 54. Attached to tract member 22 is a plurality of panel connectors 26 each having attached thereto a panel 24. It being noted that each panel connector 26 is attached to its respective panel 24 at a generally centered upper position. Such positioning is variable depending upon the applications specific circumstances. A first set of panels 28 and a second set of panels 30 are shown in the retracted position at opposing ends of tract member 22. Panels 24 extend below and to the inside of front upper surface 38 of tub 36. In this retracted position entry and exit from the showering area is allowed. Tract member 22 has incorporated within it design mechanism, more particularly describe below, which permit displacement of the panels relative to opening 54 and rotation of the panels along each individuals panel connectors vertical axis line. The opening and closing displacement movement of panels 24 along tract member 22 is facilitate by pulling on draw line 32. The opening and closing rotation of panels 24 is facilitate by pulling on rotation line 34. It being understood that such rotation would be employed when the panels are fully extended across opening 54. It being noted that each set of adjacent panels 24 are not in contact one with the other and ventilation is permitted.

FIG. 1 depicts the panels in their retracted open position, the panels retracted from the opening and rotated to not be in contact one with the next. It being understood that while the panels are shown separated into two opposing groups in this embodiment, the panels could be retracted to a single side in a second embodiment.

FIG. 2 shows the showering area illustrated in FIG. 1 following displacement of panels 24 along tract member 22. Such displacement being facilitate by pulling draw line 32. It being noted that each set of adjacent panels 24 are not in contact one with the other and ventilation is permitted. This position is referred to as the extended open position, the panels extended across the opening and rotated to not be in contact one with the next.

FIG. 3 shows the showering area illustrated in FIG. 2 following rotation of panels 24 to bring each set of adjacent panels 24 into contact one with the other to form a water barrier 56. Such rotation is facilitated by pulling on rotation line 34 to cause each panel connector 26 to pivot along its respective vertical axis line perpendicular to the horizontal. As more fully disclosed below tract member 22 has a mechanism incorporated therein to cause this rotation action to each panel connectors 26 and therefore to each panel 24 attached thereto. This position is referred to as the extended closed position, the panels extended across the opening and rotated to be in contact one with the next. It being understood that the introduction of water during the showering procedure would occur with the panels in this position.

It being recognized that the displacement of the panels to one side, or separated from a midpoint, as illustrated in FIG. 1, involve an optional step. While such displacement is preferred, the invention can be practiced as illustrated in FIG. 2 and FIG. 3. That is with the panels located in stationary positions with the rotation feature more particularly described below. The bather would manually hold the panels apart and step through the resulting opening to enter or exit the showering area.

DETAILED DESCRIPTION OF THE ELEMENTS

Figure 4:
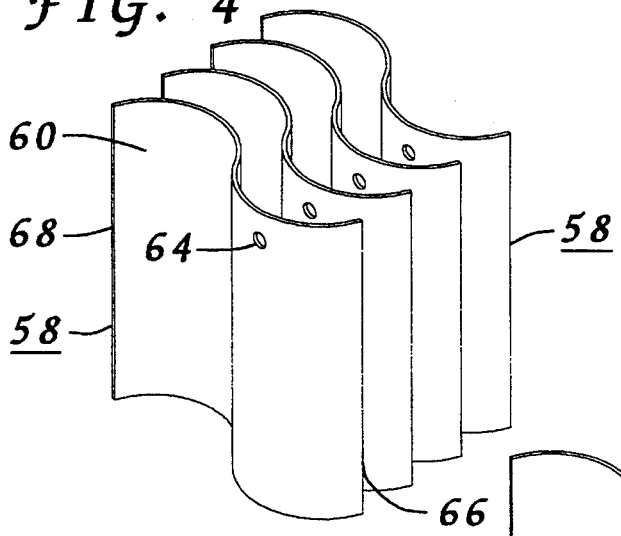
FIG. 4 is an enlarger perspective view of a cutaway section of four of the panels of a second embodiment of the invention showing the spaced relationship of the panels in the retracted position.
Figure 5:
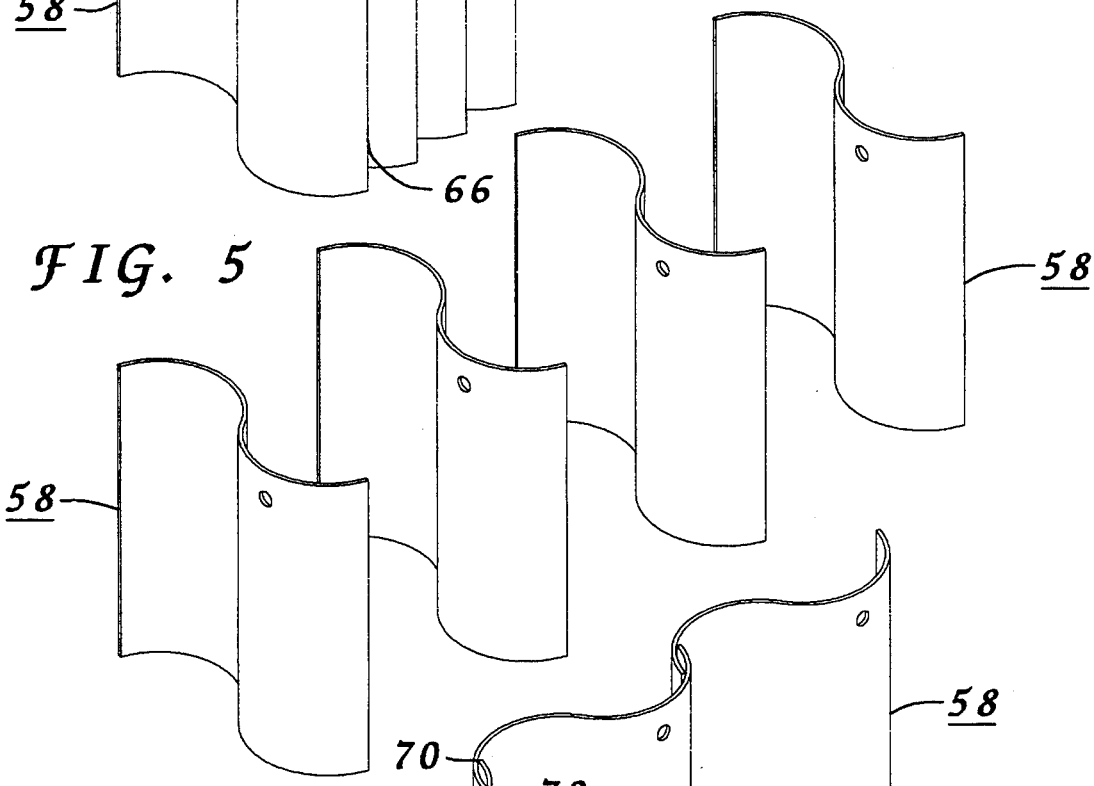
FIG. 5 is an enlarger perspective view of a cutaway section of four of the panels, as illustrated in FIG. 4, showing the spaced relationship of the panels in the extended position prior to rotation of the panels to form the water barrier.
Figure 6:
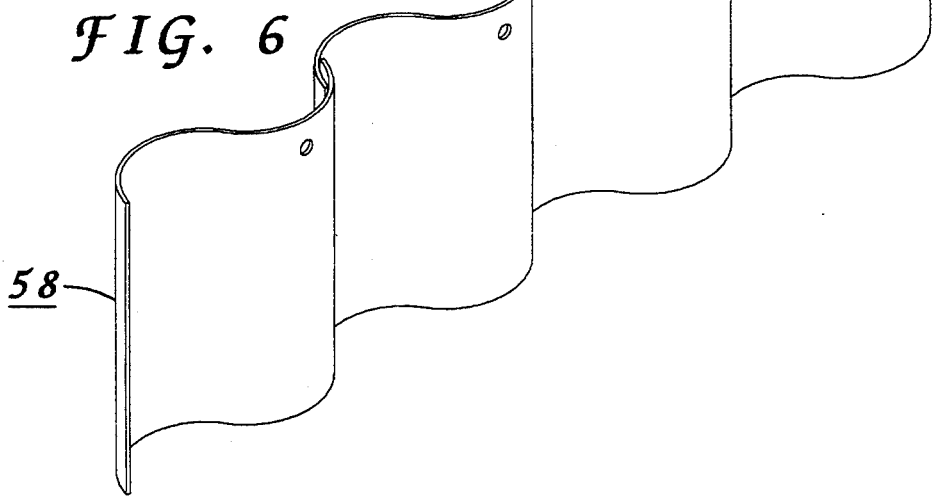
FIG. 6 is an enlarged perspective view of a cutaway section of four of the panels, as illustrated in FIG. 4 and FIG. 5, showing the overlapping feature of the panels in the extended position following rotation of the panels to form the water barrier.

FIGS. 4, 5 and 6 are perspective views showing the cutaway tops of four panels 58. Illustrated are the positions employed during use being retracted in FIG. 4, extended in FIG. 5 and extended and rotated closed in FIG. 6.

FIG. 4 illustrates the spaced positioning of each set of adjacent panels 58 one to the other. It being noted that in this fully retracted position that each panel 58 is not in contact with other panels 58 and that ventilation is provided. Each panel 58 has a first side 60, being the interior or wet side. Penetrating each panel 58 is a panel connector adaptor 64 for attachment to the tract member utilizing the panel connector as disclosed above. It being understood that each panel 58 is attached and suspended from this single point. Each panel 58 has a first edge 66 and a second edge 68 and the panels shape between these edges is ogee, double curve or S-shaped. While many material are adaptable for use in the panels, a semi-rigid plastic material is preferred. While a texture can be applied to the exterior side, the interior, wet side, is preferably smooth to facilitate proper water runoff for rapid drying. While panels of widely varying width are possible, they preferably are no wider than about four inches and preferably slightly less. The most preferred size is about two inches to two and a half inches wide.

FIG. 5 illustrates the spaced positioning of each set of adjacent panels 58 one to the other. It being noted that in this fully extended position that each panel 58 is not in contact with other panels 58 and that ventilation is provided.

FIG. 6 illustrates the contact of each set of adjacent panels 58 following extension and rotation to form the water barrier. Each adjacent set of panels 58 forms a first contact line 70 and a second contact line 72, both extending along the entire length of the panels.

Figure 7:
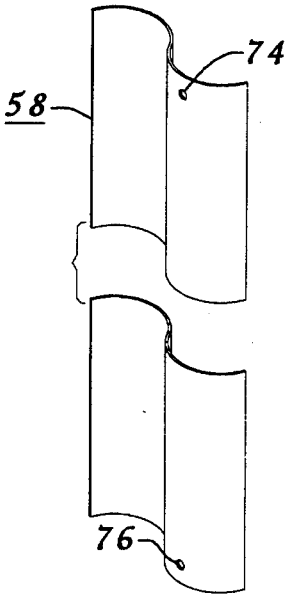
FIG. 7 is a perspective cutaway view showing the top and bottom of a panel in a first attached position.
Figure 8:
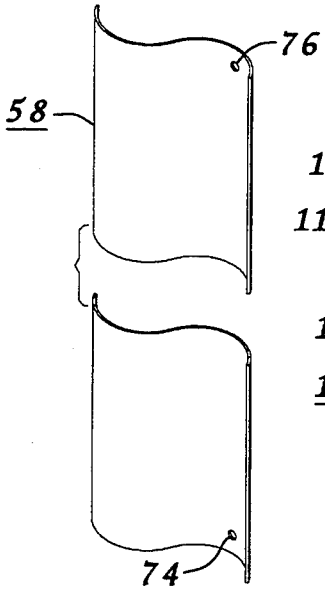
FIG. 8 is a perspective cutaway view showing the opposing attached position of the panel illustrated in FIG. 7.

FIG. 7 and FIG. 8 are perspective views of the opposing ends of panels 58 with the center section cutaway. FIG. 7 shows a panel 58 having a first panel connector adaptor 74 located at an upper position and a second panel connector adaptor 76 located at a bottom position. It being noted the relative positioning and facing direction of the edges of panel 58.

FIG. 8 shows panel 58 as illustrated in FIG. 7 following rotation end to end. It being noted that second panel connector adaptor 76 is now located at an upper position and that first panel connector adaptor 74 is now located at a bottom position. It being noted that the relative positioning provides for an opposing facing direction from that of FIG. 7. This reversal of attachment permits installation specific to the prevailing direction of the flow of water during showering. It being understood that only the upper panel connector adaptor would be utilized for attachment.

Figure 9:
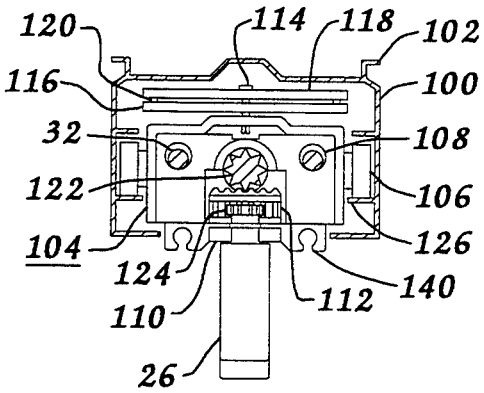
FIG. 9 PRIOR ART
FIG. 9 is a sectional plan view showing the tract and panel manipulator member as viewed from the section lines shown in FIG. 10.
Figure 10:
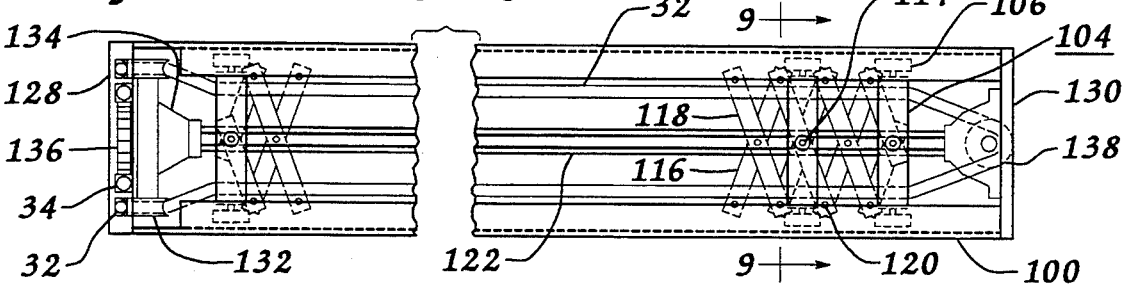
FIG. 10 PRIOR ART
FIG. 10 is a bottom cutaway view of the tract system while in a generally retracted position.
Figure 11:
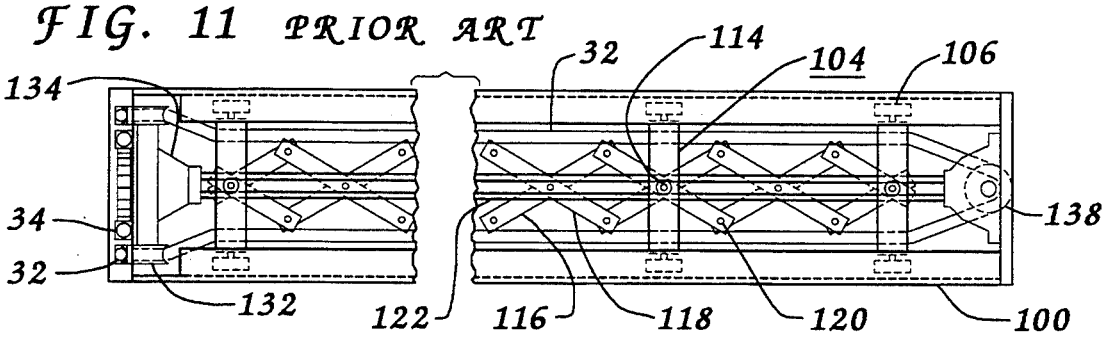
FIG. 11 PRIOR ART
FIG. 11 is a bottom cutaway view of the tract system shown in FIG. 10 while in a generally extended position.

FIGS. 9, 10 and 11 show various views of a prior art tract system as currently used for vertical blinds for window coverings.

FIG. 9 is a cutaway plan view as taken from the section lines 9 in FIG. 10. A tract housing 100 has opposing tract member mounting slots 102 which afford attachment above the opening of a showering area. A panel manipulation member 104 is slidable along the length of the tract utilizing opposing wheels 106 which each resting on a ledge 126. A snap adaptor 110 is incorporated in the design of panel manipulation member 104 for rotatable attachment of a panel connector 26. Panel connector 26 will have a panel attached in a hanging fashion thereto during operation. Panel connector 26 has a toothed adaptor 124 attached at it upper end which meshes with a dual gear plate 112 which rest in a recessed slot of panel manipulation member 104. It being understood that toothed adaptor 124 is continually in contact with one set of teeth of dual gear plate 112. The second set of teeth of dual gear plate 112 extends into the domain of a hole in panel manipulator member 104 which has inserted therethrough a rotation shaft 122. It being understood that when rotation shaft 122 is rotated such rotation causes dual gear plate 112 to move laterally within its boundaries which causes toothed adaptor 124 to cause rotation of panel connector 26. Opposing draw line holes 108 are incorporated through panel manipulation member 104 for unrestricted passage of a draw line 32. Opposing line attachments 140 are provided for securing of draw line 32 to panel manipulation member 104 which generally occurs with the end or inner members only. A lower extension member 116 and an upper extension member 118 are attached to panel manipulation member 104 by a center pivot connector 114. Lower extension member 116 is attached to upper extension member 118 utilizing a side pivot connector 120. Such upper extension members 116 and lower extension members 118 are used in sets with a panel manipulation member 104 generally placed at every other center connection point in an accordion style as illustrated in FIG. 10 and FIG. 11.

FIG. 10 is a sectional bottom view of a tract housing 100 with the various mechanism installed to permit displacement of the panels along the length of the tract and the desired rotation of the panels to closed the curtain. Panel manipulation members 104 are shown in a generally extended position, being withdrawn to opposing ends of tract housing 100. It being understood that a while only three connection locations are displayed, in use a sufficient number would be present to allow coverage of the opening to the showering area. Tract housing 100 is shown with a first end member 128 having incorporated therein a shaft rotation member 134 and a geared wheel 136 which is turned in a desired direction by pulling on either end of rotation line 34. Such pulling produces a turning of rotation shaft 122 which causes rotation of the panel connector as described above. Draw line 32 passes through first end member 128 and is guided by opposing first line guides 132. Draw line 32 then extends along the entire length of tract housing 100 passing through each panel manipulator member 104 and then goes through a second line guide 138 located in a second end member 130. Draw line 32 then passes back through each panel manipulator member 104 along the opposing side of tract housing 100 and passes back through the second first line guide 132 located in first end member 128. It being understood that the innermost panel manipulator member 104 in each opposing set is rigidly affixed to a stationary location on draw line 32 and thus is pulled in the desired direction from this point. It being further understood that the outer end panel manipulator member 104 of each of the two opposing sets is rigidly fixed to a position along tract housing 100. Panel manipulator members 104 have attached opposing wheels 106 which guide the travel along tract housing 100. As clearly illustrated a plurality of lower extension members 116 and upper extension members 118 are attached one to the other in sets utilizing center pivot connectors 114 and side pivot connectors 120. Thus expansion and contraction of the assembly is possible along the length of tract housing 100 in an accordion style, while maintaining even spacing between the panel manipulation members 104. Each panel manipulation member 104 is attached to the expansion contraction apparatus utilizing center pivot connector 114 as described above.

FIG. 11 is a sectional bottom view of tract housing 100 as illustrated in FIG. 10 in a generally retracted position. As described above draw line 32 is pulled and expansion or contraction of the assembly in facilitated. Draw line 32 being guided by opposing first line guides 132 and second line guide 138 in a loop. Lower extension members 116 and upper extension members 118, being mounted in a pivotal manner by opposing side pivot connectors 120 and center pivot connector 114, expand and contract with even spacing throughout there range of travel along tract housing 100. Panel manipulation members 104 are shown extended, having been extended by the pulling action caused by draw line 32 as describe above, and guided by opposing wheels 106. After positioned to a desired extended location, rotation line 34 is pulled causing shaft rotation member 134 to cause a turning of rotation shaft 122 causing rotation of the individual panels as described above. It being understood that due to the humid conditions plastic is utilized as much as possible in the construction of the tract system and mechanism contained therein.

It being understood that while one embodiment has the panels separated into two equal sets moveable to opposing ends of the tract during use, the possibility of placing all of the panels to one end of the tract is envisioned and disclosed. The mechanism contained within the tract depicted would have one continuous set with the first rigidly affixed as described above and the last panel manipulator member 104 having the draw line 32 rigidly attached to one side utilizing line attachment 140.

Figure 12:
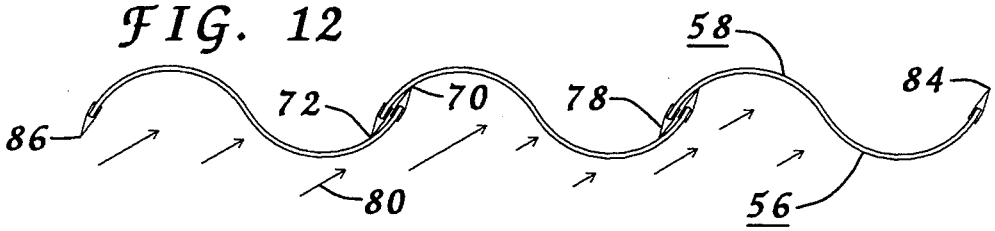
FIG. 12 is an overhead view of three panels in the extended and rotated position showing the direction of the spray of water during the showering procedure with the optional edge seal strip attached to the panels.

FIG. 12 is a top view showing three panels 58 in their extended and rotated position to form a water barrier 56. Shown is a water direction 80 which is the prevailing direction based on the spray of water from the shower head. Each panel 58 has attached opposing edge seal strips 78 which provide for enhanced sealing properties. Each panel 58 has a first edge 84 and a second edge 86 which both extend the length of panel 58. When in contact, as shown, a first contact line 70 and a second contact line 72 are formed by the contact of each set of adjacent panels 58. It being noted that the opposing arced shapes at the location of overlap of each set of adjacent panels 58 provide for a moveable seal which provides for a secure water barrier.

Figure 13:
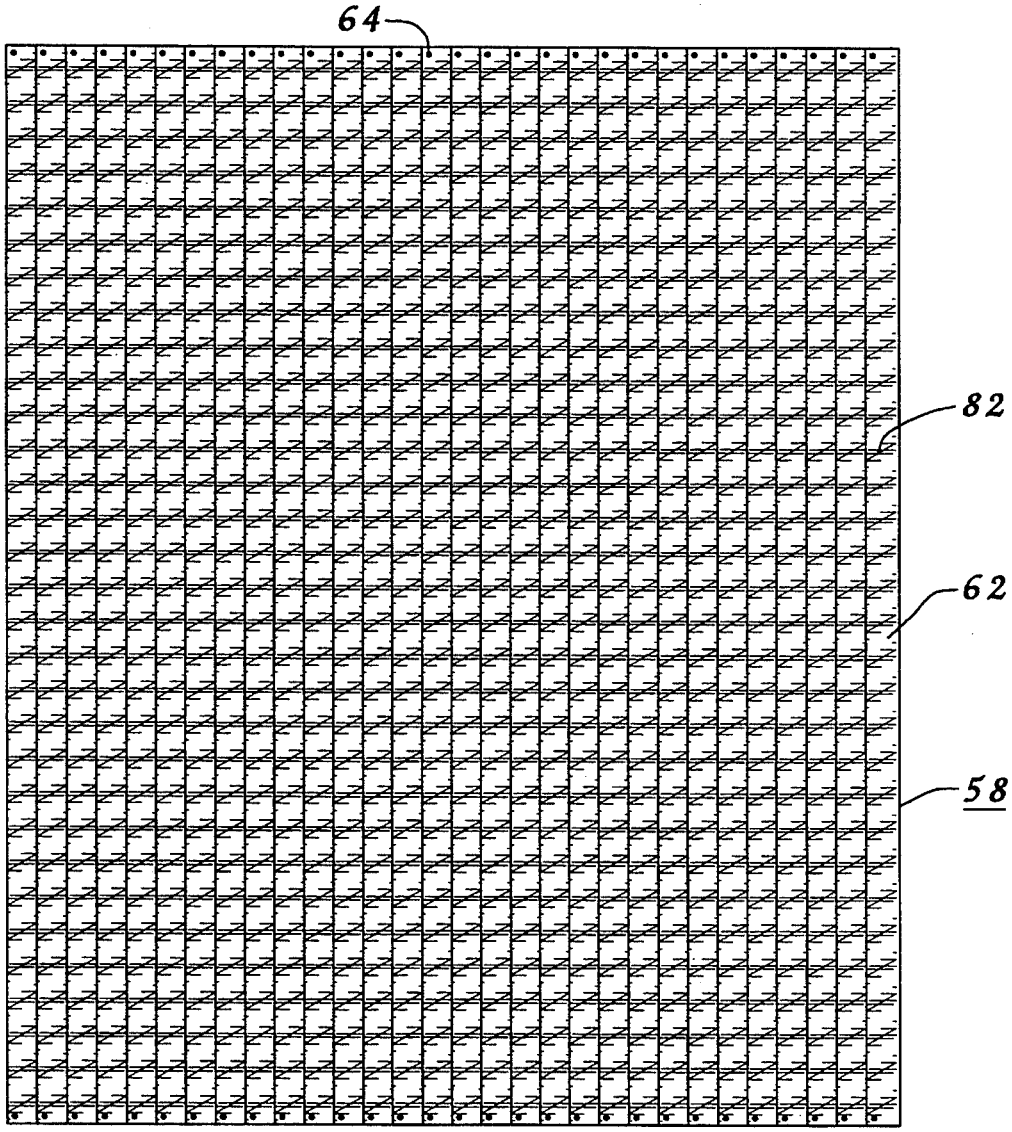
FIG. 13 is a front plan view of a multi-paneled shower curtain illustrating the optional feature of a printed pattern on the panels.

FIG. 13 is a front plan view of thirty panels 58 each having opposing panel connector adaptors 64 for attachment to the panel connectors, not shown. It being understood that the showering area resides behind panels 58 with a second side 62 of each panel 58 visible. Second side 62 is the exterior side of panels 58 and has printed, or otherwise affixed, a pattern 82 for ascetic appeal. It being understood that a single pattern can be applied to all of the panels in a set, as shown, or a more elaborate pattern can be formed over many panels. Such an elaborate pattern would required installation in the proper sequence.

ADVANTAGES OF THE INVENTION

The previously described embodiments of the present invention have many advantages, including the provision for providing adequate protection to prevent the escape of water from the showering area during a showering procedure. A principal benefit lies in the use of panels having opposing sides formed in a curved configuration. This design provides for a moveable double seal to be formed during use. Additionally the ability of provide adequate ventilation to all wet surfaces following the completion of the showering procedure is an advantage. A further advantage is the ability to provide for an attractive covering to conceal the showering area, following drying of the area, by providing for the optional application of a printed or textured pattern to the exterior side of the panels.

ALTERNATIVES AND CLOSING

While a showering area comprising a bathtub has been illustrated, it is understood that the invention is applicable to any showering area. While panels with a smooth contoured surface have been illustrated, various shapes and patterns are possible. While a smooth contoured surface is the most advantageous, with the double moveable contact lines between each adjacent set of panels, other possibilities exist such as three intersecting planes. Any configuration that places the opposing edges of each panel facing in opposing directions would perform a similar function of allowing for an overlapping barrier to be formed. Such possibilities are envisioned and disclosed.

I claim:

1. A multi-paneled, retractable shower curtain assembly for a showering area, the showering area having a first side member, a second side member, an opening located between the first side member and the second side member, the opening for the entry and exit of bathers and having a top and a bottom, the curtain assembly installed corresponding to the opening of the showering area and having the purpose of restricting the distribution of sprayed water to the showering area, the curtain assembly comprising;

a) a plurality of panels, each panel formed of a water resistant material and having a top end, a bottom end, an inner side, an outer side, a first edge extending from the top end to the bottom end, a second edge extending from the top end to the bottom end, each panel having an ogee shaped cross section between the first edge and the second edge, the ogee shape being "S" shaped and comprising a single concave shaped section followed by a single convex shaped section;

b) a plurality of panel connectors, each panel connector having attached thereto one of the panels;

c) an elongated tract member attached along the top of the opening of the showering area, the tract member having attached thereto the panel connectors with attached panels, the panels of the tract member having a retracted open position, an extended open position, an extended closed position, the tract member having displacement means for extending and retracting the panels along the length of the tract member between the retracted open position and the extended open position, rotation means to rotate the panels along a vertical axis line perpendicular to the horizontal between the extended open position and the extended closed position, the extended closed position placing the adjacent panels in overlapping contact with a concave portion of one panel overlapping a convex portion of another panel such that the first edge of said one panel contacts the concave portion of said another panel while the second edge of said another panel contacts the convex portion of said one panel as to provide two lines of contact between respective adjacent panels in order to form a water barrier.

2. The multi-paneled, retractable shower curtain assembly of claim 1 wherein the displacement means comprises separating the panels into two relatively equal groups for grouping at opposing ends of the tract while in the retracted open position.

3. The multi-paneled, retractable shower curtain assembly of claim 1 wherein the displacement means comprises movement of the panels to one end of the tract while in the retracted open position.

4. The multi-paneled, retractable shower curtain assembly of claim 1 wherein the displacement means provides for even spacing of the panels, one to the next, during movement between the retracted open position and the extended open position.

5. The multi-paneled, retractable shower curtain assembly of claim 1 further comprising a pattern affixed to the outer side of the panels.

6. The multi-paneled, retractable shower curtain assembly of claim 1 further comprising a sealing edge member installed on the first edge and the second edge of each of the panels.

7. The multi-paneled, retractable shower curtain assembly of claim 1 further comprising panel reversing means, the panel reversing means permitting connection to the panel connectors placing the panels in the opposing orientation to provide for installation dependent on the prevailing water flow direction.

8. A multi-paneled shower curtain assembly for a showering area, the showering area having a first side member, a second side member, an opening located between the first side member and the second side member, the opening for the entry and exit of bathers and having a top and a bottom, the curtain assembly installed corresponding to the opening of the showering area and having the purpose of restricting the distribution of sprayed water to the showering area, the curtain assembly comprising;

a) a plurality of panels, each panel formed of a water resistant material and having a top end, a bottom end, an inner side, an outer side, a first edge extending from the top end to the bottom end, a second edge extending from the top end to the bottom end, each panel having an ogee shape cross section between the first edge and the second edge, the ogee shape being "S" shaped and comprising a single concave shaped section followed by a single convex shaped section;

b) a plurality of panel connectors, each panel connector having attached thereto one of the panels;

c) an elongated tract member attached along the top of the opening of the showering area, the tract member having attached thereto the panel connectors with attached panels and having a uniform stationary spacing between panels along the length of the tract member, the panels having an open position and a closed position, rotation means to rotate the panels along a vertical axis line perpendicular to the horizontal between the open position and the closed position, the closed position having the adjacent panels in overlapping contact with a concave portion of one panel overlapping a convex portion of another panel such that the first edge of said one panel contacts the concave portion of said another panel while the second edge of said another panel contacts the convex portion of said one panel as to provide two lines of contact between respective adjacent panels in order to form a water barrier.

9. The multi-paneled shower curtain assembly of claim 8 further comprising a pattern affixed to the outer side of the panels.

10. The multi-paneled shower curtain assembly of claim 8 further comprising a sealing edge member installed on the first edge and the second edge of each of the panels.

* * * * *